US010975813B2

(12) United States Patent
McCann et al.

(10) Patent No.: US 10,975,813 B2
(45) **Date of Patent: *Apr. 13, 2021**

(54) AIR INTAKE SYSTEM FOR AN ENGINE

(71) Applicant: Ford Global Technologies, LLC, Dearborn, MI (US)

(72) Inventors: Joseph Matthew McCann, Plymouth, MI (US); Michael Marvin Landgraf, Huntington Woods, MI (US); David Lowrie, Windsor (CA); Jeff Sean Boulton, Carleton, MI (US); Preet Kamal Virk, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/512,283

(22) Filed: Jul. 15, 2019

(65) Prior Publication Data

US 2021/0017940 A1 Jan. 21, 2021

(51) Int. Cl.

| | |
|---|---|
| ***F02M 35/16*** | (2006.01) |
| ***F02M 35/108*** | (2006.01) |
| ***F02M 35/024*** | (2006.01) |
| ***F02M 35/10*** | (2006.01) |

(52) U.S. Cl.

CPC .... *F02M 35/108* (2013.01); *F02M 35/02491* (2013.01); *F02M 35/10091* (2013.01); *F02M 35/161* (2013.01)

(58) Field of Classification Search

CPC ..... F02M 35/10013; F02M 35/161; F02M 35/108; F02M 35/02491; F02M 35/10091

USPC ..... 123/302, 308, 585, 184.52, 198 E

See application file for complete search history.

(56) References Cited

U.S. PATENT DOCUMENTS

| | | | | |
|---|---|---|---|---|
| 4,420,057 | A | 12/1983 | Omote et al. | |
| 6,889,490 | B2 * | 5/2005 | Hornung | F01P 1/02 56/16.7 |
| 7,393,372 | B2 | 7/2008 | Cassell et al. | |
| 8,048,179 | B2 * | 11/2011 | Miller | F02M 35/024 123/198 E |
| 8,241,382 | B2 | 8/2012 | Pham et al. | |
| 9,062,639 | B1 * | 6/2015 | MacKenzie | B62D 25/12 |
| 9,068,537 | B2 | 6/2015 | Khami et al. | |
| 10,280,879 | B2 * | 5/2019 | Stempien | F02M 35/088 |
| 10,465,640 | B1 * | 11/2019 | Wolgamott | F02M 35/161 |
| 10,514,007 | B2 * | 12/2019 | McCann | F02M 35/10091 |
| 2010/0140004 | A1 * | 6/2010 | Ohzono | F02M 35/10144 180/68.3 |
| 2014/0165961 | A1 * | 6/2014 | Patel | F02M 35/10255 123/337 |
| 2015/0159599 | A1 | 6/2015 | Baldwin et al. | |
| 2016/0090946 | A1 | 3/2016 | Tomlin et al. | |

(Continued)

*Primary Examiner* — Gonzalo Laguarda

(74) *Attorney, Agent, or Firm* — Geoffrey Brumbaugh; McCoy Russell LLP

(57) ABSTRACT

Methods and systems are provided for an air intake system. In one example, an air intake system is provided. The air intake system includes a first air inlet duct providing intake air to an engine intake conduit, the first air inlet duct including an opening positioned external to an engine compartment. The air intake system also includes a second air inlet duct positioned upstream of the engine intake conduit and external to the engine compartment, the second air inlet duct including a funnel shaped to flow air to only a portion of an air filter.

17 Claims, 6 Drawing Sheets

(56) References Cited

U.S. PATENT DOCUMENTS

| | | | | |
|---|---|---|---|---|
| 2016/0090947 | A1 | 3/2016 | Tomlin et al. | |
| 2018/0372038 | A1 | 12/2018 | McCann et al. | |
| 2020/0011277 | A1* | 1/2020 | McCann ..... | F02M 35/10091 |

* cited by examiner

AIR INTAKE SYSTEM FOR AN ENGINE

FIELD

The present description relates generally to an air intake system for an internal combustion engine.

BACKGROUND/SUMMARY

Engines have, in the past, utilized multiple air inlets to feed air to airboxes. Using multiple inlets provides a high flowrate of filtered air to internal combustion engines. High intake flowrates may be particularly desirable in compression ignition engines, which may demand, during certain operating conditions, a large amount of intake airflow to drive combustion. However, depending on the location of the air inlet, the inlet may be susceptible to damage, clogging, etc., from external road debris (e.g., snow, ice, rocks, etc.).

Previous intake systems have attempted to protect air inlets by placing the inlet in a more shielded vehicle location to reduce the inlet's exposure to road debris. One example approach shown by MacKenzie et al., in U.S. Pat. No. 9,062,639, is a dual inlet air induction system. In MacKenzie's air induction system, one air inlet is positioned under an engine compartment hood and another air inlet is located in a fender panel. The inventors have recognized several drawbacks with MacKenzie's system. For instance, in MacKenzie's system, the inlet positioned under the hood receives air at elevated temperatures, due to the inlet's proximity to hot engine components. Elevated intake air temperatures can decrease combustion efficiency and in some cases may lead to pre-ignition, knock, etc. Therefore, MacKenzie's system as well as other intake systems have in the past made tradeoffs between the degree of air inlet shielding and the temperature of the air drawn into the inlet.

Other attempts have been made to actively control airflow through different air inlets. For instance, one example approach shown by Miller et al., in U.S. Pat. No. 8,048,179, includes an intake system having two air inlets with one of the inlets having a flow valve positioned therein. The valve is opened during cold weather conditions to draw hot air into a portion of the intake system that may be obstructed by snow. However, the active control system, described in Miller, may be prone to malfunction or in some cases failure due to the complexity of the control system used to adjust the flow valve. Furthermore, active flow valves may be costly and as a result the production costs of vehicles using active valves may be unduly increased. Additionally, Miller's system only allows a single airflow path to be opened at any one time.

Another attempt to protect air inlets and block ingestion of foreign particles is shown by McCann et al. in U.S. Patent Application Publication No. 2018/0372038. Therein, a small foam insert is arranged in a lower duct, wherein the foam insert may block external road debris from flowing to the engine. However, the foam insert may freeze as snow accumulates. Furthermore, the foam insert restricts the lower duct during all engine operating conditions. As a result, airflow may be partially restricted and temperatures may be elevated.

The inventors have recognized the aforementioned problems and in confronting these problems have developed an air intake system. In one example, the issues described above may be addressed by a system comprising a multi-port air intake system comprising a first duct and a second duct configured to provide air to an air filter, wherein a funnel extends from the second duct and is in face-sharing contact with the air filter. In this way, only a portion of the filter corresponding to the funnel may freeze during cold-weather events.

As one example, the funnel divides the air filter into two portions, a first portion and a second portion. The first portion may be fluidly coupled to the first duct arranged above the second duct. The first duct may be arranged in a location where intake air temperatures are higher, thereby decreasing the likelihood of snow or ice flowing therethrough. The second duct may be arranged in a location where airflow is higher than at the first duct, but a temperature of the airflow is lower and may comprise snow or ice. The funnel may concentrate airflow through the second duct to only the second portion of the air filter. By doing this, only the second portion of the air filter may freeze, while blocking snow and ice from entering the engine as air from the first duct flows through the unfrozen, first portion of the air filter.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2 through 7B are shown to scale, however, other dimensions may be used if desired.

DETAILED DESCRIPTION

Figure 1:
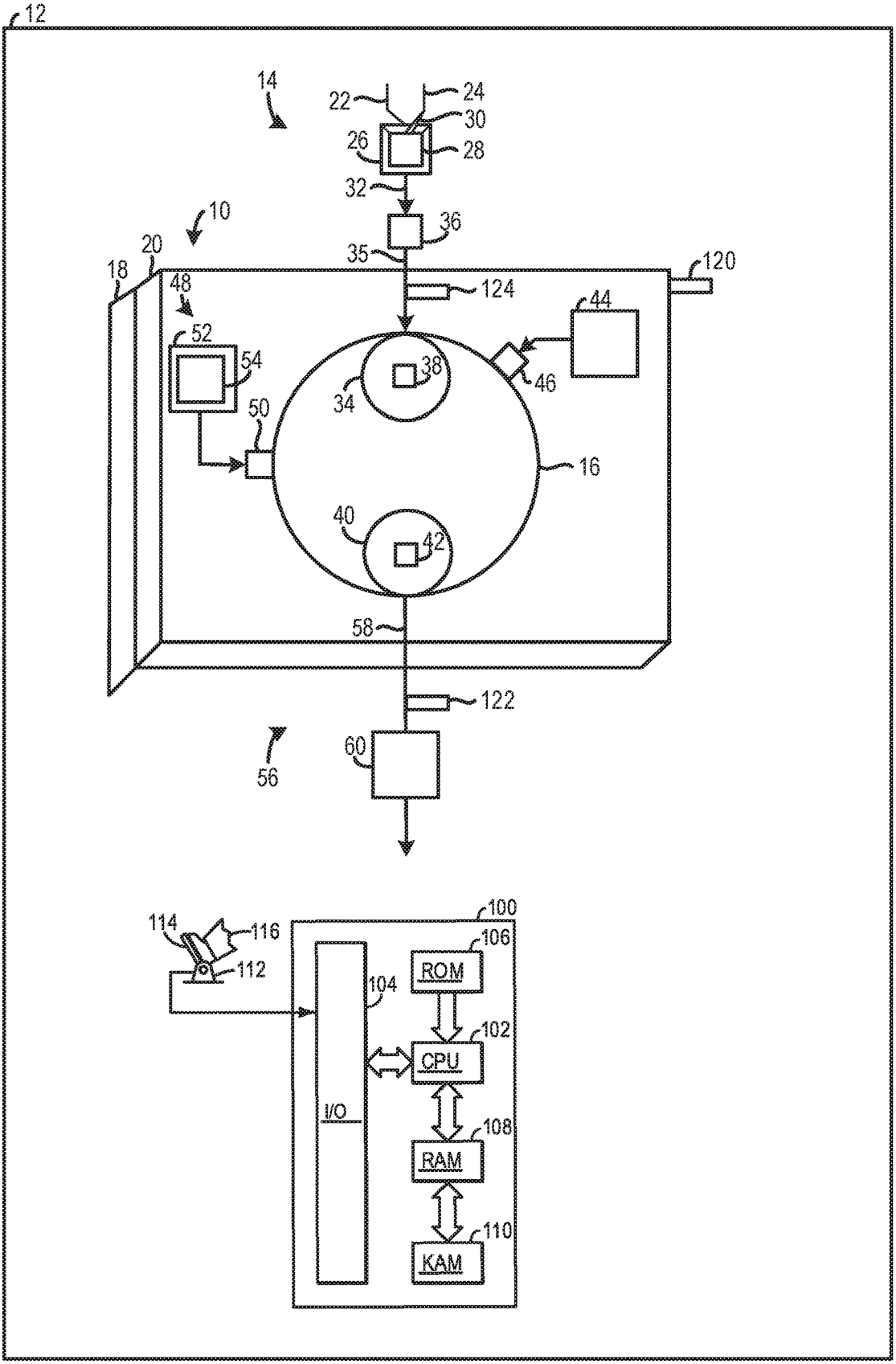
FIG. 1 shows a schematic depiction of an internal combustion engine including an air intake system.

The following description relates to an air intake system providing airflow to an engine. The air intake system may include, in one example, a first air inlet duct spaced away from the second air inlet duct. Additionally, the second air inlet duct may include a funnel extending from the second air inlet duct to an air filter element. The funnel may be adapted to block only an opening of the second air inlet duct when below a threshold temperature (e.g., at or near freezing) by clogging a portion of the air filter element corresponding to the funnel and allow airflow therethrough when above the threshold temperature. In this way, when external environmental factors (e.g., snowy/icy conditions) are likely to cause intake system degradation, airflow through the second air inlet duct may be inhibited, while allowing increased (e.g., maximum) airflow during conditions where system degradation is unlikely. The second air inlet duct is free of valves and/or devices that are electrically, mechanically, or pneumatically actuated. For instance, while driving in snowy conditions, previous systems may suck snow into an air inlet, which may cause significant engine degradation or even shut-down, in some instances. However, in the air intake system described herein, pores in the air filter may clog up with snow and/or ice particles to block the snow from traveling into the intake system, during cold temperature conditions. In one example, the portion of the air filter fluidly coupled to the funnel is a temperature dependent foam, wherein a pore size of the foam may decrease as temperatures decrease. However, during lower hazard conditions (e.g., above freezing ambient temperature conditions) air may freely flow through the portion of the air filter element corresponding to the funnel. In this way, the funnel is shaped to allow only a portion of the air filter to clog with snow and other particles during cold weather conditions, while allowing air to freely flow through the portion of the air filter outside of cold weather conditions. In this way, the funnel may passively block snow and other contaminants from flowing to the engine during some conditions while allowing intake air to freely flow during other conditions.

In one example, the embodiments provided herein illustrate a multi-port air intake system configured to provide increase filtered airflow during non-snow conditions while blocking the ingestion of snow during snow-conditions. The multi-port air intake system may comprise at least two ducts, a first duct arranged in a warmer location and a second duct arranged in a cooler location. The second duct may provide cooler intake air, which may enhance vehicle performance. However, the second duct may be susceptible to ingestion of snow, ice, or other particles during some engine operating conditions, while the first duct may be positioned to avoid these negative effects. Thus, it is desired to block the ingestion of unwanted particles through the second duct. Furthermore, an element to block the ingestion of unwanted particles through the second duct without incurring increased emissions due to actuation of a valve or other electronic device is desired.

In one example, a solid funnel, which may traverse through an airbox of the multi-port intake system from the second duct and butt up against an air filter component may automatically block ingestion of the unwanted particles. During conditions where an ambient temperature is less than a threshold temperature (e.g., 0° C.), snow may enter the second duct and plug up the second duct. Since the filter butts up against the air filter, a further path for the snow to escape the second duct and flow to the engine is unavailable. In this way, during the snowy condition, all engine intake air routes up through a vehicle baffling/hood latch to the first air duct. The first air duct may ingest less snow or no snow due to higher temperatures. Additionally gravity may block larger pieces of snow from flowing through a path of the first air duct to the engine.

Figure 2:
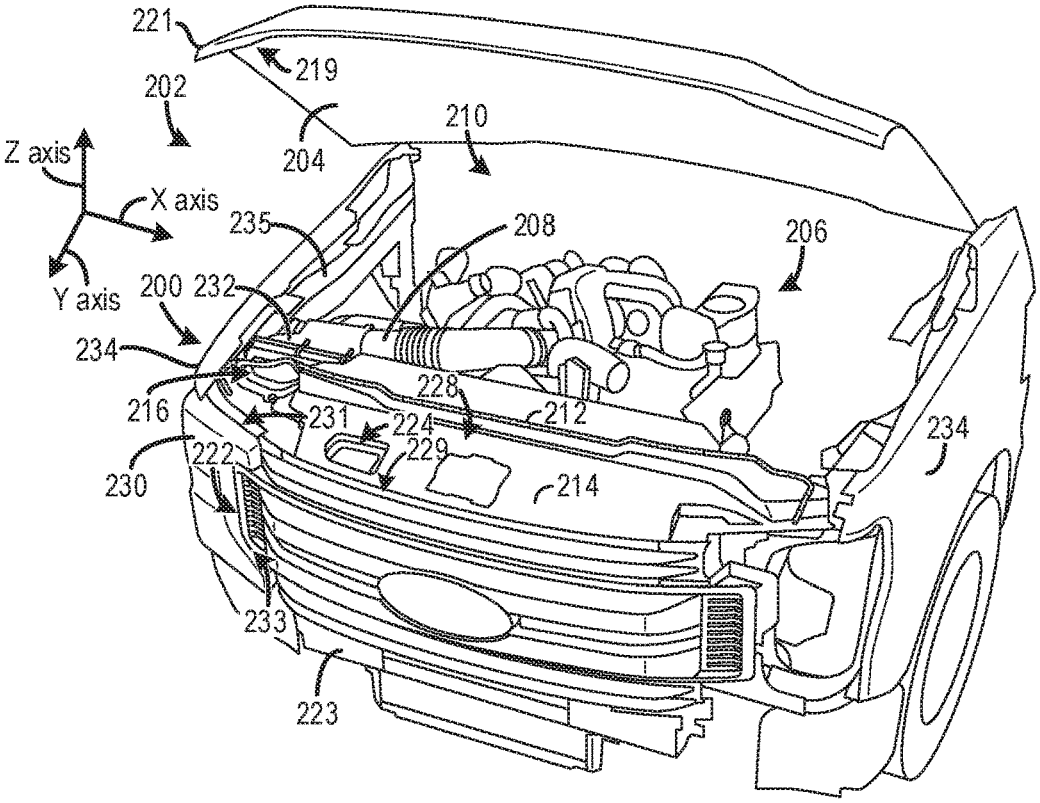
FIG. 2 shows a perspective view of an exemplary vehicle including an air intake system.
Figure 3:
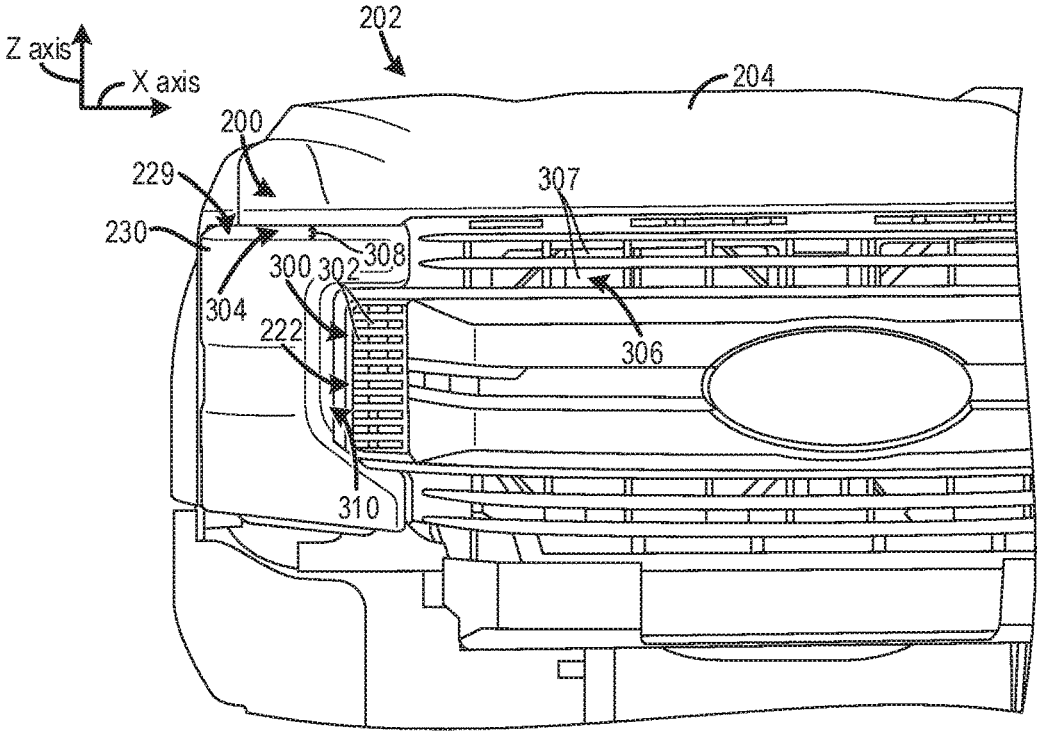
FIG. 3 shows a front view of the vehicle and the air intake system, shown in FIG. 2.
Figure 4:
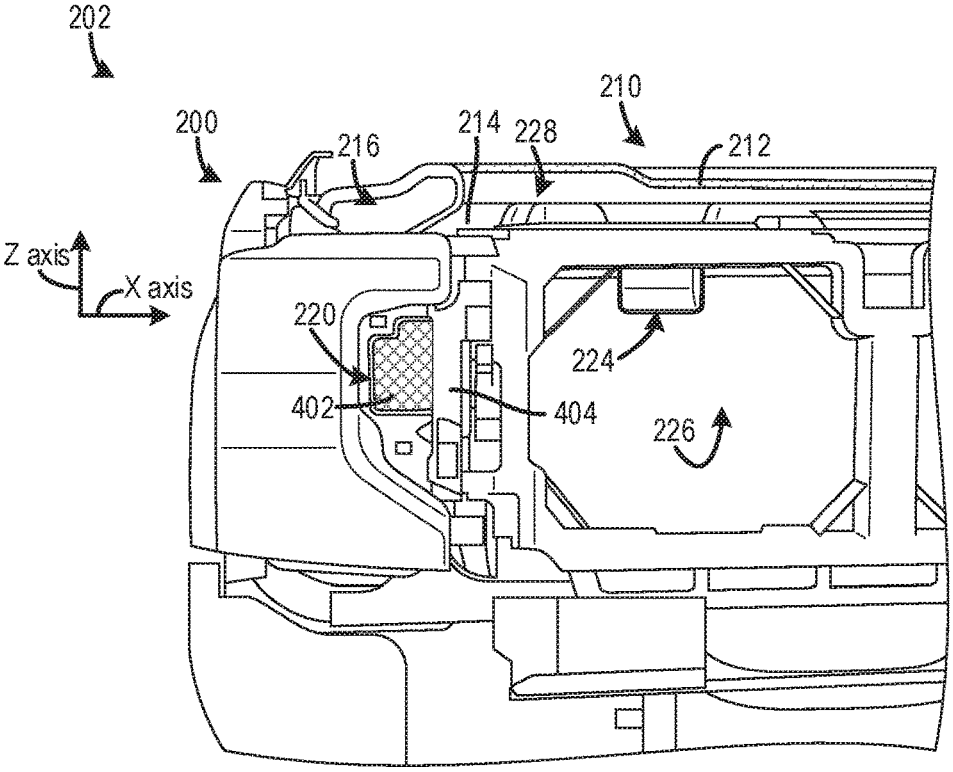
FIG. 4 shows a detailed view of a portion of the air intake system, shown in FIG. 2.
Figure 5:
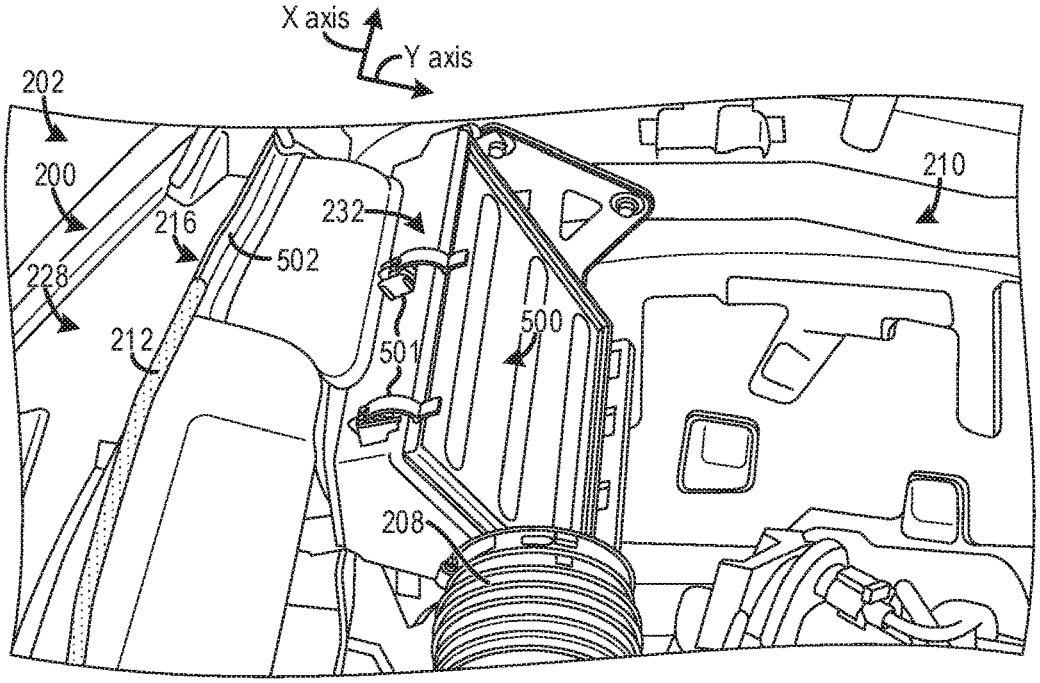
FIG. 5 shows another detailed view of the air intake system, shown in FIG. 2.
Figure 6:
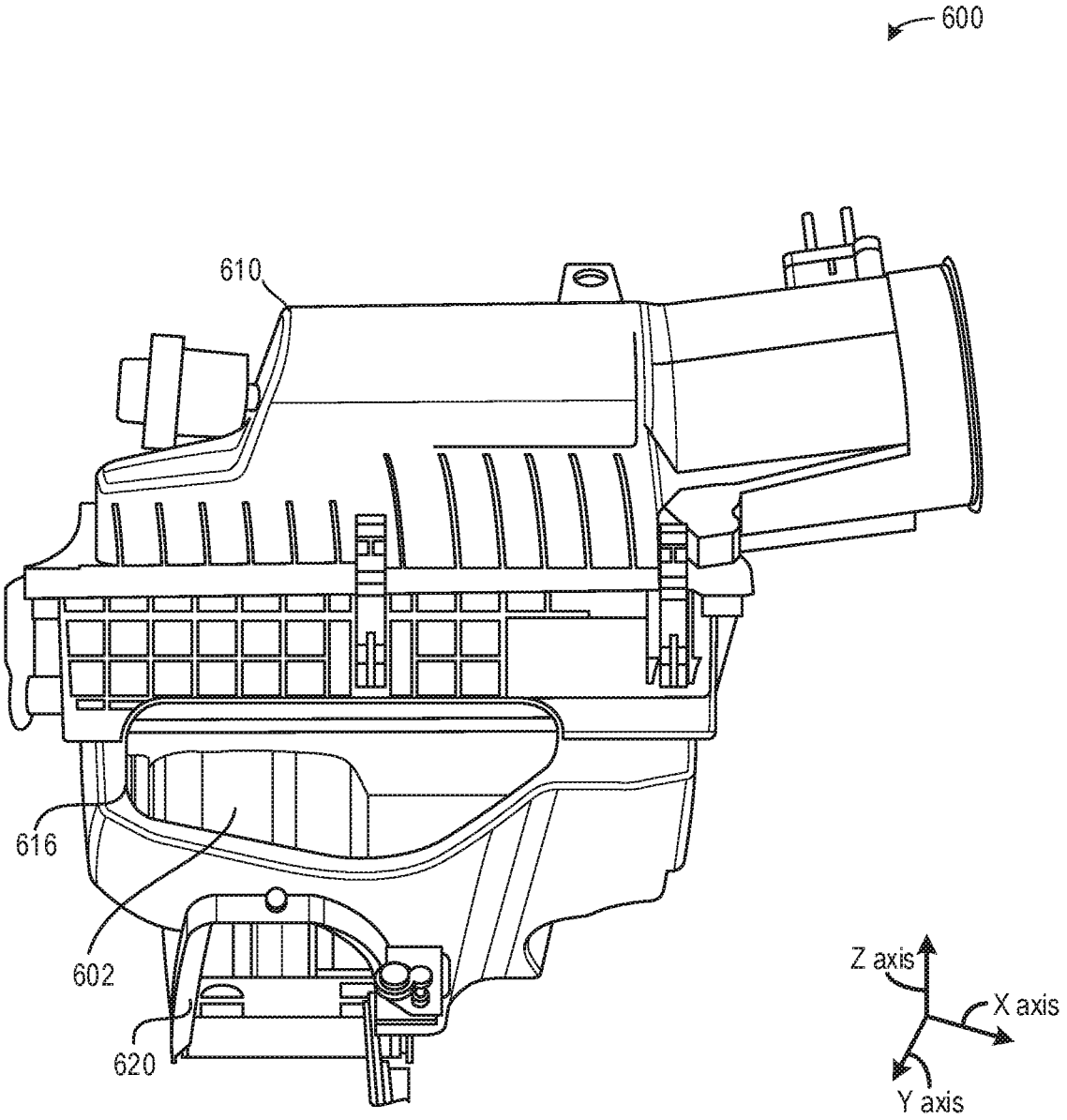
FIG. 6 shows a detailed, perspective view of the first and second air inlets and airbox in the air intake system, shown in FIG. 2.
Figure 7A:
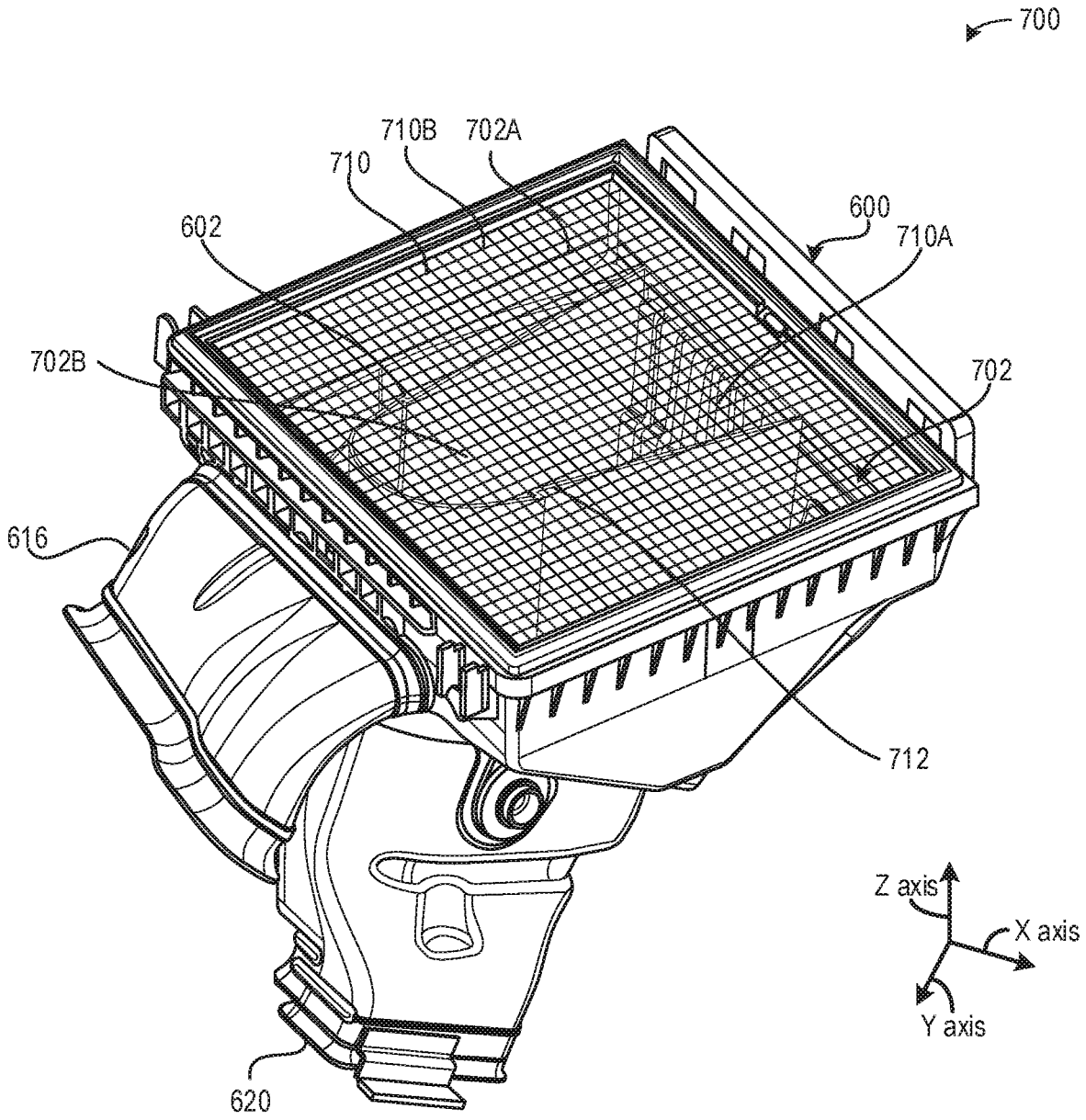
FIGS. 7A and 7B show a detailed view of the second air inlet in the air intake system, shown in FIG. 6.
Figure 7B:
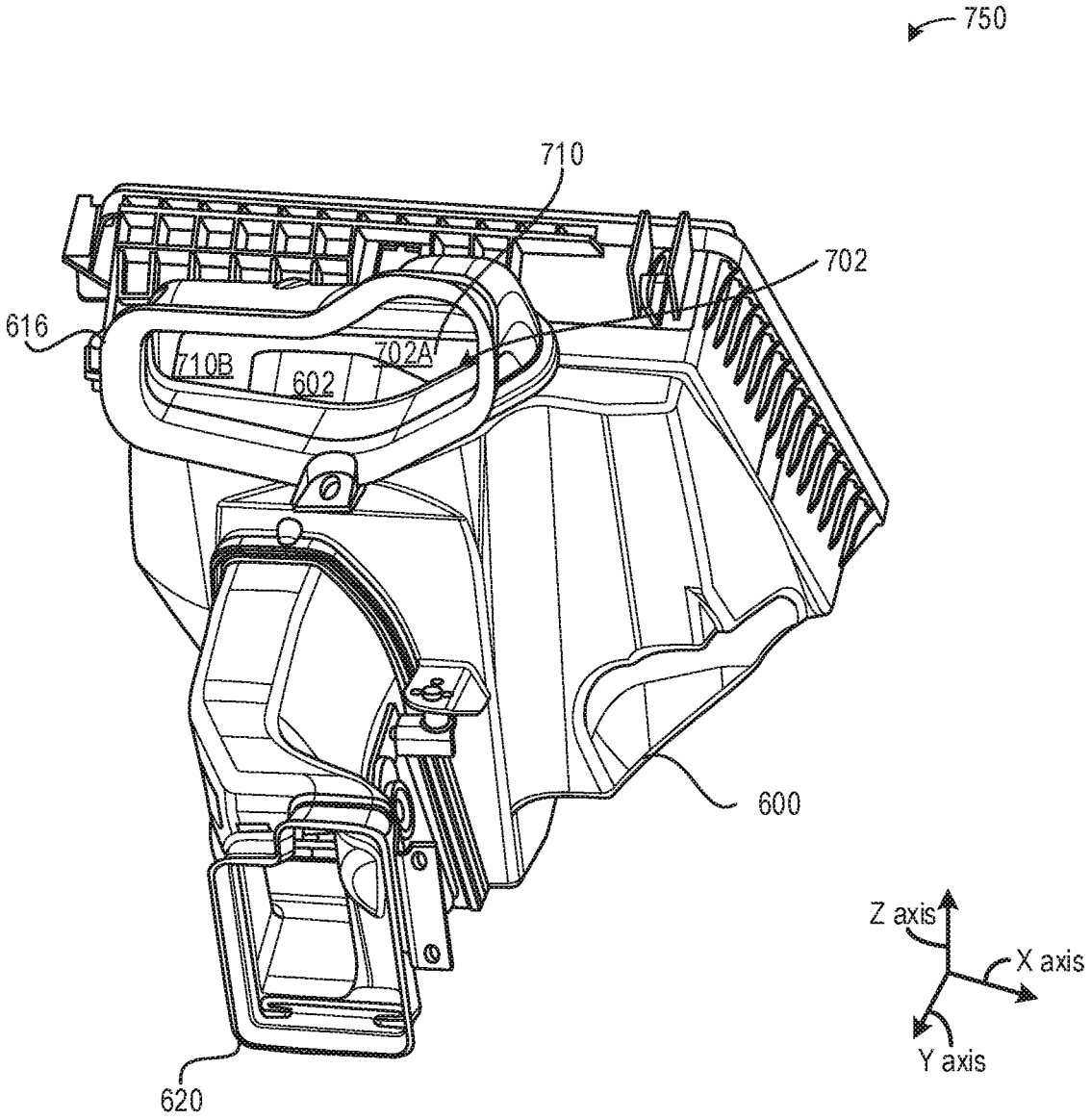

FIG. 1 shows a schematic depiction of an engine employing a robust air intake system with multiple air inlet ducts. FIG. 2 shows an example of a vehicle with an air intake system. FIG. 3 shows a front view of the air intake system, shown in FIG. 2. FIGS. 4 and 5 show more detailed views of the air intake system shown in FIG. 2. FIGS. 6, 7A, and 7B show detailed views of a first and second air inlet duct, an airbox, and an engine intake conduit included in the air intake system, shown in FIG. 2.

Turning to FIG. 1, an engine 10 in a vehicle 12 with an air intake system 14 providing airflow to the engine 10 is schematically illustrated. Although FIG. 1 provides a schematic depiction of various engine, vehicle, and air intake system components, it will be appreciated that at least some of the components may have a different spatial positions and greater structural complexity than the components shown in FIG. 1. The components' structural characteristics are discussed in detail herein, with regard to FIGS. 2-7B.

The air intake system 14 specifically provides intake air to a cylinder 16. The cylinder 16 is formed by a cylinder block 18 coupled to a cylinder head 20. Although FIG. 1 depicts the engine 10 with one cylinder, the engine 10 may have an alternative number of cylinders, in other examples. For instance, the engine 10 may include two cylinders, three cylinders, six cylinders, etc., in other examples.

The air intake system 14 includes a first air inlet duct 22 and a second air inlet duct 24. Each of the first and second air inlet ducts, 22 and 24, provide intake air to an airbox 26 having a filter 28 configured to remove particulates from air flowing therethrough. The first and second air inlet ducts may be spaced away from one another and positioned in strategic locations that provide varying degrees of protection from external debris, described in detail herein.

The second air inlet duct 24 includes a funnel 30 shaped to selectively impede airflow through the second air inlet duct 24 in combination with a portion of the filter 28. Specifically, the funnel 30 may direct intake air to only the portion of the filter 28. As will be shown in greater detail in FIGS. 7A and 7B, the funnel 30 may fluidly couple only the second air inlet duct 24 to only the portion of the filter 28. In one example, the funnel 30 may block intake air from the first air inlet duct 22 from mixing with air in the second air inlet duct 24. Additionally, the funnel 30 may butt up (e.g., directly contact) to the portion of the air filter 28 such that air in the funnel 30 may only flow through the portion of the air filter 28 and not to other portion of the air filter 28. By doing this, air from the first air inlet duct 22 may not flow through the portion of the air filter 28.

For instance, the portion of the filter 28 may impede (e.g., inhibit) airflow therethrough when the filter is below a threshold temperature (e.g., 0 degrees Celsius, 2 degrees Celsius, 5 degrees Celsius, in the range between −5 degrees Celsius and 5 degrees Celsius, in the range between 1 degree Celsius and 3 degrees Celsius, etc.) and snow and/or ice particulates have been drawn into the portion of the filter 28. Thus, when the filter 28 is below the threshold temperature, pores in the portion of the filter may clog with snow particles and freeze to block airflow therethrough. On the other hand, when the portion of the filter 28 is above the threshold temperature, the filter adapts to permit airflow through pores in the portion of the filter 28. In this way, when above the threshold temperature, the portion of the filter 28 is in a porous state where air can travel through the portion of the filter 28. To enable the aforementioned temperature dependent adaptation, the portion of the filter 28 may include a foam material, such as polyether. Specifically, in one example, the portion of the filter 28 may be constructed solely out of polyether. However, other materials, including other foam materials, have been contemplated. Further, in one example, a porosity of the filter 28 may be between 30 and 80 pores per inch, to provide the filter with desired temperature dependent airflow characteristics. When the portion of the filter 28 has a porosity between 30 and 80 pores per inch, a desired amount of airflow may flow therethrough when above a threshold temperature and conversely when the portion of the filter 28 is below the threshold temperature, the foam may substantially inhibit airflow therethrough, due to snow particulates blocking pores in the filter 28. In another example, the porosity of the filter 28 may be between 40 and 60 pores per inch. It will be appreciated that the filter 28 may also assist in blocking large debris (e.g., pebbles, leaves, insects, etc.,) and rain droplets from entering a downstream air filter. Additionally, in one specific example, the density of the portion of the filter 28 may be selected to address specific vehicle working applications (e.g., mining vehicles, border patrol vehicles, etc.,) such as vehicles subjected to large amounts of dust, dirt, and/or sand. In one example, such as in air intake systems designed for dusty and sandy environments, the portion of the filter 28 may include foam having a density around 30 pores per inch. In another example, such as in air intake systems designed for cold weather environments, the portion of the filter 28 may include foam having a density around 80 pores per inch. However, materials with other densities may be used, in other examples.

Additionally or alternatively, the portion of the filter 28 which corresponds to the funnel 30 may comprise a material similar to a remainder of the filter 28 that receives air from the first air inlet duct 22. Thus, in some examples, the portion of the filter 28 may comprise a material different than or identical to a material of the remainder of the filter 28.

The airbox 26 feeds intake air to an engine intake conduit 32. The engine intake conduit 32, in turn, provides air to an intake valve 34 coupled to the cylinder 16. A throttle 36 may be positioned in an engine intake conduit 35 positioned downstream of the engine intake conduit 32. It will be appreciated that in other examples, such as in the case of a multi-cylinder engine, an intake manifold may be coupled to the engine intake conduit and provide intake air to a plurality of intake valves.

The intake valve 34 may be actuated by an intake valve actuator 38. Likewise, an exhaust valve 40 may be actuated by an exhaust valve actuator 42. In one example, both the intake valve actuator 38 and the exhaust valve actuator 42 may employ cams coupled to intake and exhaust camshafts, respectively, to open/close the valves. Continuing with the cam driven valve actuator example, the intake and exhaust camshafts may be rotationally coupled to a crankshaft. Further in such an example, the valve actuators may utilize one or more of cam profile switching (CPS), variable cam timing (VCT), variable valve timing (VVT) and/or variable valve lift (VVL) systems to vary valve operation. Thus, cam timing devices may be used to vary the valve timing, if desired. In another example, the intake and/or exhaust valve actuators, 38 and 42, may be controlled by electric valve actuation. For example, the valve actuators, 38 and 42, may be electronic valve actuators controlled via electronic actuation. In yet another example, the cylinder 16 may alternatively include an exhaust valve controlled via electric valve actuation and an intake valve controlled via cam actuation including CPS and/or VCT systems. In still other embodiments, the intake and exhaust valves may be controlled by a common valve actuator or actuation system.

An ignition system 44 may provide spark to the cylinder 16 via an ignition device 46 (e.g., spark plug) at desired time intervals. However, in compression ignition configurations the engine 10 may not include the ignition system 44. Additionally, a fuel delivery system 48 is also shown in FIG. 1. The fuel delivery system 48 provides pressurized fuel to the fuel injector 50 from a fuel tank 52 having a fuel pump 54. In the depicted example, the fuel injector 50 is a direct fuel injector. However, additionally or alternatively, the fuel delivery system may be configured to deliver what is commonly referred to in the art as port fuel injection via a port fuel injector positioned upstream of the intake valve. The fuel delivery system 48 may include conventional components such as additionally or alternative fuel pumps, check valves, return lines, etc., to enable fuel to be provided to the injectors at desired pressures.

An exhaust system 56 configured to manage exhaust gas from the cylinder 16 is also included in the vehicle 12, depicted in FIG. 1. The exhaust system 56 includes the exhaust valve 40 coupled to the cylinder 16, and an exhaust conduit 58. The exhaust system 56 also includes an emission control device 60. The emission control device 60 may include filters, catalysts, absorbers, etc., for reducing tailpipe emissions.

FIG. 1 also shows a controller 100 in the vehicle 12. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 10. The sensors may include engine coolant temperature sensor 120, exhaust gas sensors 122, an intake airflow sensor 124, etc. Additionally, the controller 100 is also configured to receive throttle position (TP) from a throttle position sensor 112 coupled to a pedal 114 actuated by an operator 116.

Additionally, the controller 100 may be configured to trigger one or more actuators and/or send commands to components. For instance, the controller 100 may trigger adjustment of the throttle 36, intake valve actuator 38, exhaust valve actuator 42, ignition system 44, and/or fuel delivery system 48. Therefore, the controller 100 receives signals from the various sensors and employs the various actuators to adjust engine operation based on the received signals and instructions stored in memory of the controller.

During engine operation, the cylinder 16 typically undergoes a four stroke cycle including an intake stroke, compression stroke, expansion stroke, and exhaust stroke. It will be appreciated that the cylinder may also be referred to as a combustion chamber. During the intake stroke, generally, the exhaust valves close and intake valves open. Air is introduced into the cylinder via the corresponding intake conduit, and the piston moves to the bottom of the cylinder so as to increase the volume within the cylinder. The position at which the piston is near the bottom of the cylinder and at the end of its stroke (e.g., when the cylinder is at its largest volume) is typically referred to by those of skill in the art as bottom dead center (BDC). During the compression stroke, the intake valves and exhaust valves are closed. The piston moves toward the cylinder head so as to compress the air within cylinder. The point at which the piston is at the end of its stroke and closest to the cylinder head (e.g., when the cylinder is at its smallest volume) is typically referred to by those of skill in the art as top dead center (TDC). In a process herein referred to as injection, fuel is introduced into the cylinder. In a process herein referred to as ignition, the injected fuel in the cylinder is ignited by a spark from an ignition device (e.g., spark plug), resulting in combustion. It will be appreciated that in other examples the engine may employ compression ignition. Therefore, the ignition system may be omitted from the engine, in some instances. A crankshaft converts this piston movement into a rotational torque of the rotary shaft. During the exhaust stroke, in a traditional design, exhaust valves are opened to release the residual combusted air-fuel mixture to the corresponding exhaust passages and the piston returns to TDC.

FIGS. 2-5 show different views and features of an exemplary air intake system 200 and vehicle 202 and FIGS. 6, 7A, and 7B show detailed views of the air intake system 200. It will be appreciated that the air intake system 200 and the vehicle 202 may be similar to the air intake system 14 and the vehicle 12, shown in FIG. 1. In FIGS. 2-7B coordinate axes, X, Y, and Z are provided for reference. In one example, the Z axis may be parallel to a gravitational axis. Further, the X axis may be a lateral or horizontal axis and the Y axis may be a longitudinal axis. However, in other examples, the air intake system 200 and the vehicle 202 may have other orientations.

Turning to FIG. 2, a perspective view of the vehicle 202 and air intake system 200 is shown. The vehicle 202 includes an engine hood 204. In FIG. 2, the engine hood 204 is illustrated in an open position to reveal the components positioned below the hood (e.g., engine 206, engine intake conduit 208, etc.). However, it will be appreciated that the engine hood 204 may be closed to seal an engine compartment 210, when the vehicle 202 is in motion. In particular, the engine hood 204 may at least partially seal on an engine compartment seal 212 extending laterally across a beauty cover 214, when in a closed position.

FIG. 2 also shows a first air inlet duct 216. It will be appreciated that the first air inlet duct 216 may be positioned below a front section 219 of the engine hood 204 when the engine is in the closed position. The boundary of the front section 219 may be the interface between the engine hood 204 and the engine compartment seal 212 when the hood is closed. Specifically, when the engine hood 204 is closed, the first air inlet duct 216 may be adjacent to a front corner 221 of the engine hood 204. In this way, the first air inlet duct 216 can be spaced away from hot engine components located in more central locations under the engine hood 204 to reduce the temperature of the air entering the duct. Furthermore, the front section 219 of the engine hood 204, when closed, extends down over the first air inlet duct 216 to shield the duct from external debris. The first air inlet duct 216 provides airflow to an airbox 232. A second air inlet duct 220, shown in FIG. 4, is positioned behind a front grille 222, shown in FIG. 2. The front grille 222 is positioned above a front bumper shell 223, in the illustrated example. Additionally, the second air inlet duct 220 provides airflow to the airbox 232, during certain operating conditions. An air conduit 224 is also shown in FIG. 2. The air conduit 224 extends from a first compartment 226 behind the front grille 222, shown in FIG. 4, to a second compartment 228, below the engine hood 204, when the hood is closed. Specifically, the second compartment 228 is positioned external to the engine compartment 210 and in front of the engine compartment seal 212. Moreover, a beauty cover 214 may form a lower boundary of the second compartment 228. Furthermore, the second compartment 228 may receive airflow from a gap 308, shown in FIG. 3, between the engine hood 204 and an upper section 231 of a headlamp 230, when the hood is closed. As shown, the gap 308 also laterally extends to a location between an upper section 229 of the front grill 222 and the engine hood 204. Returning to FIG. 2, the headlamp 230 is positioned adjacent to the front grille 222 on a lateral side (e.g., passenger or driver side) of the grille. Thus, the front grille 222 may be positioned on an interior side 233 of the headlamp 230 with regard to a lateral direction. Additionally, the front grille 222 is on a leading side of the vehicle 202 during forward motion of the vehicle.

Continuing with FIG. 2, the airbox 232 is configured to flow filtered intake air to the engine intake conduit 208. The engine intake conduit 208 provides air to at least one cylinder in the engine 206, such as the cylinder 16 shown in FIG. 1. In some examples, the air may flow to a compressor prior to flowing to the at least one cylinder. FIG. 2 also shows opposing vehicle side panels 234 of the vehicle's body structure that form a portion of the boundary of the engine compartment 210. As shown in FIG. 2, the first air inlet duct 216 may be positioned adjacent to one of the side panels 234 and/or a frame rail 235.

FIG. 3 shows a front view of the air intake system 200 and vehicle 202, shown in FIG. 2, with the engine hood 204 in a closed position. The air intake system 200, in the depicted example, provides air to the second air inlet duct 220, shown in FIG. 4, via a flow channel 300. As shown in FIG. 3, the flow channel comprises openings 302 in the front grille 222. The openings 302 laterally extend across the front grill 222, in the illustrated example. However, other front grille opening contours have been contemplated. Positioning the flow channel 300 in this location enables ambient air with a low temperature to be provided to the airbox 232, shown in FIG. 2. Furthermore, the front grille 222 protects the second air inlet duct 220 from external debris.

FIG. 3 also shows a first flow channel 304 and a second flow channel 306, in the air intake system 200, that provide air to the first air inlet duct 216, shown in FIG. 2. The first flow channel 304 travels through the gap 308 between the engine hood 204 and the headlamp 230 and into a second compartment 228 below the engine hood 204 and above the beauty cover 214, shown in FIG. 2. The second flow channel 306 travels through openings 307 in the front grille 222. Subsequently, the second flow channel 306 travels through an air conduit 224 extending between the first compartment 226 behind the front grille 222, shown in FIG. 4, and the second compartment 228, shown in FIG. 2. In this way, the first air inlet duct 216 can receive airflow from multiple shielded locations that may be less susceptible to drawing in road debris (e.g., snow, ice, rocks, etc.). However, in other examples, additional or alternative flow channels providing air to the air inlet ducts have been contemplated.

FIG. 3 also shows the front grille 222 extending into a recessed section 310 of the headlamp 230. Arranging the front grille 222 in this manner enables the second air inlet duct 220 to be positioned behind the grille.

In one example, the first air inlet duct 216, the first flow channel 304, the second flow channel 306, shown in FIG. 3, and/or the airbox 232, shown in FIG. 2 may form a first air inlet flow path routing airflow to the engine intake conduit 208, shown in FIG. 2. Continuing with such an example, the second air inlet duct 220, shown in FIG. 4, the flow channel 300 including openings 302, and/or the airbox 232, shown in FIG. 2, may form a second air inlet flow path routing air through a funnel 402, shown in FIG. 4, to the engine intake conduit 208, shown in FIG. 2. The funnel 402 may be configured to flow air to only a portion of an air filter, such as air filter 28 of FIG. 1. It will be appreciated that the funnel 402 may be similar to the funnel 30, shown in FIG. 1. Thus, the funnel 402, shown in FIG. 4, may be configured to inhibit airflow through the second air inlet duct 220 when a temperature of the portion of the air filter is below a threshold temperature and allow airflow therethrough when the portion of the air filter is above the threshold temperature. In this way, the airbox has two separate flow paths that enable increased airflow to be provided to the airbox during conditions where particulates are less likely to flow to the engine, thereby increasing combustion efficiency. However, during conditions where particulates are more likely to flow to the engine, the second flow path may be essentially blocked by snow particulates in the air filter to reduce the likelihood of snow, ice (e.g., in the event humidity is relative high and an ambient temperature is less than or equal to a freezing temperature), and/or other external debris being sucked into intake system and negatively impacting combustion operation. During the same conditions, the first flow path may not be blocked due to a shape of the funnel 402 blocking snow, ice, and/or other external debris from flowing to other portions of the air filter and mixing with air from the first flow path. Additionally or alternatively, snow may be blocked from entering the first flow path due to warmer temperatures along with an upward flow path, which may result in snow being unable to overcome a force of gravity to enter or complete the first flow path.

Turning again to FIG. 4, which shows a front view of the vehicle 202 without the front grille 222 and the engine hood 204, shown in FIGS. 2 and 3, to reveal the location of the first air inlet duct 216 and the second air inlet duct 220.

As shown in FIG. 4, the first air inlet duct 216 is positioned vertically above the second air inlet duct 220. Positioning the air inlet ducts in this manner enable the first air inlet duct 216 to be more protected from the external environment than the second air inlet duct 220 due to both a vertical positioning of the first air inlet duct 216 being higher than the second air inlet duct 220 and heat from adjacent components heating the first air inlet duct 216 more than the second air inlet duct 220. Additionally, when the second air inlet duct 220 is positioned below the first air inlet duct 216, the second air inlet duct 220 may have a greater airflow rate and/or receive cooler air than the first air inlet duct. Furthermore, the second air inlet duct 220 is positioned external to the engine compartment 210, in the illustrated example. Additionally, at least an inlet opening of the first air inlet duct 216 may be positioned external to the engine compartment 210.

Consequently, the temperature of the air drawn into the inlet ducts may be reduced when compared to ducts located in the engine compartment. As previously discussed, the engine compartment seal 212 may form a portion of the boundary between the engine compartment 210 and external components. The second air inlet duct 220 is also shown positioned adjacent to a grille reinforcement structure 404. In this way, both the air inlet ducts can be spaced away from hot engine components, thereby decreasing the temperature of the air traveling into the ducts. However, other locations of both the first and second air inlet ducts have been contemplated. For instance, the first and/or second air inlet duct may be positioned in the driver or passenger side fender, tucked into a wheel well, under-hood adjacent to a cowl, etc.

FIG. 4 also shows the air conduit 224 providing airflow between the first compartment 226 and the second compartment 228. In this way, air can be routed in a protected manner to the first air inlet duct 216 away from hot engine components. As a result, the temperature of the air provided to the first air inlet duct 216 may be reduced while providing a shielded flow path to the duct. The air conduit 224 extends in a vertical direction, in the illustrated example. However, alternate routing of the air conduit 224 has been contemplated.

FIG. 4 also shows the first air inlet duct 216 extending upward from the beauty cover 214 to a location between sections of the engine compartment seal 212. In this way, the duct may act to draw in increased amounts of air while being protected by the engine hood 204, shown in FIG. 3. Additionally, the beauty cover 214 may be recessed to accommodate the first air inlet duct 216, in one example.

FIG. 5 shows another view of the air intake system 200. The first air inlet duct 216, the second compartment 228, the engine compartment seal 212, the airbox 232, and the engine intake conduit 208, are shown in FIG. 5. A portion of the housing of the airbox 232 is removed in FIG. 5 to show a filter 500 included in the airbox. FIG. 5 also shows clips 501 configured to releasably attach a removable section of the airbox 232. The filter 500 is configured to trap particulates from the air provided by both the first air inlet duct 216 and the second air inlet duct 220, shown in FIG. 4. In this way, clean air can be provided to the engine intake conduit 208.

FIG. 5 shows the first air inlet duct 216 including a housing lip 502. As shown, the housing lip 502 is aligned with the engine compartment seal 212 to enable the housing lip to seal with a portion of the engine hood 204, shown in FIGS. 2 and 3. Therefore, in the depicted example, the housing lip 502 and the engine compartment seal 212 may interface with the engine hood 204, shown in FIGS. 2 and 3, to seal the engine compartment 210. Additionally, it will be appreciated that the lip 502 may be positioned between two sections of the engine compartment seal 212. However, in other examples, the engine compartment seal 212 may extend across the lip 502. Consequently, the second air inlet duct 220 may be efficiently packaged in the air intake system 200 to reduce the profile of the system. As a result, space saving gains can be achieved by the air intake system 200.

FIG. 6 shows a detailed view of a multi-port air induction system 600. The multi-port air induction system 600 is a non-limiting example of the air intake system 14 of FIG. 1. The multi-port air induction system 600 comprises a first air inlet duct 616 and a second air inlet duct 620. The first air inlet duct 616 is a non-limiting example of the first air inlet duct 216 of FIGS. 2, 4, and 5 and to the first air inlet duct 22 of FIG. 1. The second air inlet duct 620 is a non-limiting example of the second air inlet duct 620 of FIG. 4, and second air inlet duct 24 of FIG. 1. As such, the multi-port air induction system 600 may be arranged in the engine compartment 210, shown in FIG. 2, and shaped to flow air to the at least one cylinder of the engine.

As illustrated and described above, the first air inlet duct 616 is arranged above the second air inlet duct 620. This arrangement may allow the first air inlet duct 616 to be protected from debris, snow, rain, ice, and other elements other than air that may clog an air filter or disrupt engine activity. However, a drawback to the first air inlet duct 616, relative to the second air inlet duct 620, is that a temperature of air entering the first air inlet duct 616 may be hotter than air entering the second air inlet duct 620. As such, airflow through both inlet ducts is desired during a plurality of engine operating conditions in order to decrease combustion temperatures. Furthermore, blocking foreign particles from entering the second air inlet duct 620 that may interfere with engine activity, such as combustion, may be desired.

A funnel 602, which may be used similarly to funnel 30 of FIG. 1 and funnel 402 of FIG. 4, is shown extending from the second air inlet duct 620 toward an air filter housing 610. More specifically and as will be described below in greater detail, the funnel 602 extends to an intersection where the multi-port air induction system 600 merges with the air filter housing 610. At the intersection, an air filter (e.g., air filter 28 of FIG. 1) is arranged and filters one or more contaminants from air flowing through each of the first air inlet duct 616 and the second air inlet duct 620.

In one example, the funnel 602 may divide the air filter into a first portion that receives air from only the first air inlet duct 616 and a second portion that receives air from only the second air inlet duct 620. The air filter is porous and thus air in the first portion of the air filter may flow to the second portion of the air filter, or vice versa. However, the funnel 602 extends from the second air inlet duct 620 and presses against the air filter, such that air from the second air inlet duct 620 may only enter through the second portion of the air filter. Thus, the funnel 602 may block air from the first air inlet duct 616 from entering the air filter via the second portion. In this way, air from the first air inlet duct 616 may enter the air filter via only the first portion. The air filter, the funnel, and airflow from both are described in greater detail below with respect to FIGS. 7A and 7B.

Turning now to FIG. 7A, it shows a first perspective view 700 of the multi-port air induction system 600. The air filter housing, such as the air filter housing 610 of FIG. 6, is omitted to reveal the funnel 602 pressing up against an air filter 710. The air filter 710 may be used similarly to the air filter 28 of FIG. 1.

The funnel 602 may comprise plastic, metal, cast iron, aluminum, magnesium, other similar materials, and/or combinations thereof that shape the funnel 602. The funnel 602 may extend from the second air inlet duct 620 such that air from the second air inlet duct 620 may only flow through the funnel 602. That is to say, the multi-port air induction system 600 comprises an interior volume 702, which is fluidly coupled to the air filter 710. The interior volume 702 may be divided into a first portion 702A and a second portion 702B via the duct 602. The duct 602 may block air in the first portion 702A from mixing with air in the second portion 702B. As such, air, snow, and other particles, gases, and liquids may not flow through surfaces of the duct 602.

In one example, a volume of the first portion 702A may be equal to a volume of the second portion 702B. Additionally or alternatively, the volume of the first and second portions 702A, 702B may be adjusted based on environmental conditions. For example, if a vehicle will be operated in cold conditions or on a gravel road, then the volume of the second portion 702B, and therefore a size of the funnel 602, may be increased. Alternatively, if the vehicle is planned to be operated in warm conditions on a smooth, paved road, then the volume of the second portion 702B may be decreased. In some examples, the volume of the first portion 702A may be between 1.01 to 2 times greater than the volume of the second portion 702B.

In one example, the funnel 602 is sized such that greater than 50% of the air filter is free to allow intake airflow therethrough. In some examples, the funnel 602 is sized such that greater than 55% and less than 80% of the air filter is free of snow. In some examples, additionally or alternatively, the funnel 602 is sized such that between 60 to 70% of the air filter is free of snow and configured to allow intake airflow therethrough. In this way, the second portion 702B may be equal to 30 to 40% of the interior volume 702.

The funnel 602 comprises a frustoconical shape in one example. In another example, the funnel 602 comprise a trapezoid prism shape. In one example, a cross-section of the funnel 692 comprises a trapezoid shape. To enhance airflow therethrough, the funnel 602 may be free of 90 degree angled corners. In one example, the funnel 602 comprises two acute corners and two obtuse corners.

More specifically, the two acute corners may correspond to a widest portion of the funnel 602. The widest portion may be physically coupled to an interior surface of the multi-port air induction system 600, wherein the interior surface is opposite the first air inlet duct 616. The funnel 602 narrows toward a narrowest portion of the funnel 602. The narrowest portion is adjacent to the first air inlet duct 616 and spaced away from interior surfaces of the multi-port air induction system 600 and an opening of the first air inlet duct 616. In this way, air from the first air inlet duct 616 flowing through the first portion 702A of the interior volume 702 may flow around all portions of the funnel 602 except for the widest portion in face-sharing contact with interior surfaces of the multi-port air induction system 600.

The funnel 602 is shown in face-sharing contact with the air filter 710. An entire outer rim 712 of the funnel 602 is pressed against the air filter 710. The funnel 602 is shaped such that snow and other elements entering the second air inlet duct 620 flow through only the second portion 702B and contact only a portion of the air filter 710 corresponding to the second portion 702B. In the example of FIG. 7A, the portion of the air filter 710 in contact with the second portion 702B is a central portion 710A. Thus, snow and other elements may be caught by the central portion 710A. During snowy conditions where a temperature of the air filter 710 and/or intake air may be less than a threshold temperature, the central portion 710A of the air filter 710 may freeze, thereby blocking airflow therethrough. In this way, the second air inlet duct 620 may not supply air to the engine. However, due to a shape of the funnel, an outer portion 710B of the air filter 710, which receives air from the first portion 702A via the first air inlet duct 616 may not clog or freeze, thereby continuing to flow air to the engine. Once the temperature is greater than the threshold temperature, each of the first and second air inlet ducts 616, 620 may flow air to the engine. As described above, a material of the central portion 702A may be similar or different to a material of the outer portion 702B. In one example, the outer portion 702B is a mesh material and the central portion 702A is a foam material, wherein the mesh material may be unaffected by temperature changes and the foam material may be affected by temperature changes. For example, if the temperature is less than the threshold temperature, the foam may freeze solid, thereby blocking air and particles therein from flowing through the central portion 702A while the mesh may continue to allow air to flow through the outer portion 702B Turning now to FIG. 7B, it shows a second perspective view 750 of the multi-input air induction system 600. The funnel 602 is observable through an opening of the first air inlet duct 616, wherein the funnel 602 is pressed against the air filter 710. As such, the second portion 702B of the interior volume 702 and the central portion 710A of the air filter 710 are occluded in the second perspective view 750 due to walls of the funnel 602.

The first portion 702A and the outer portion 710B are viewable in the second perspective view. The first portion 702A is shaped to flow air from the first air inlet duct 616 around walls of the funnel 602 and to the outer portion 710B of the air filter 710 without flowing the air into the funnel 602.

FIGS. 1-7B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

In this way, airflow to an engine may be uninterrupted during cold-weather conditions while still blocking snow and/or ice from being ingested. For vehicles with multi inlet ducts configured to flow air to the engine, it may be desired to arrange at least one of the ducts in a more exposed region to decrease inlet air temperatures while also increasing airflow. However, the more exposed duct may ingest ice and snow during cold-weather conditions. A funnel extending from an opening of the more exposed duct and abutting with an air filter may block the ingestion of snow and ice, while still permitting sufficient airflow through other inlet ducts of the air inlet system. The technical effect of arranging a funnel in a multi-port air intake system is to direct air from one of the plurality of ports to only a portion of an air filter, so that only the portion of the air filter freezes during cold-weather conditions while the other ports may continue to flow air through unfrozen portions of the air filter.

An embodiment of a system comprises a multi-port air intake system comprising a first duct and a second duct configured to provide air to an air filter, wherein a funnel extends from the second duct and is in face-sharing contact with the air filter.

A first example of the system further comprises where the funnel is free of a valve.

A second example of the system, optionally including the first example, further comprises where the first duct is positioned longitudinally behind the second duct with regard to a direction of forward travel of a vehicle in which the multi-port air intake system is mounted.

A third example of the system, optionally including one or more of the previous examples, further comprises where the first duct is positioned vertically above the second duct with respect to a direction of gravity.

A fourth example of the system, optionally including one or more of the previous examples, further comprises where the funnel fluidly separates the first duct from the second duct.

A fifth example of the system, optionally including one or more of the previous examples, further comprises where the multi-port air intake system comprises an interior volume divided into a first portion fluidly separated from a second portion, the first portion fluidly coupled to only the first duct, the second portion fluidly coupled to only the second duct.

A sixth example of the system, optionally including one or more of the previous examples, further comprises where the first duct is positioned under a section of an engine hood.

A seventh example of the system, optionally including one or more of the previous examples, further comprises where the first duct is configured to flow air to only an outer portion of the air filter, wherein the second duct is configured to flow air to only a central portion of the air filter.

An eighth example of the system, optionally including one or more of the previous examples, further comprises where the funnel comprises a trapezoid-shaped cross-section.

A ninth example of the system, optionally including one or more of the previous examples, further comprises where the funnel is free of right corners.

An embodiment of an air intake system for an engine of a vehicle, comprises a first air inlet duct configured to flow air to only a first portion of an interior volume of a multi-port air induction system and a second air inlet duct configured to flow air to only a second portion of the interior volume through a funnel free of a valve, the second air inlet duct arranged below the first air inlet duct.

A first example of the air intake system further comprises where the first air inlet duct receives airflow from a first flow channel extending through a gap between an engine hood and a headlamp of the vehicle.

A second example of the air intake system, optionally including the first example, further comprises where the interior volume is directly fluidly coupled to an air filter, wherein the first portion is fluidly coupled to only an outer portion of the air filter, and wherein the second portion is fluidly coupled to only a central portion of the air filter.

A third example of the air intake system, optionally including one or more of the previous examples, further comprises where the funnel hermetically seals the second portion from the first portion.

A fourth example of the air intake system, optionally including one or more of the previous examples, further comprises where air from the first air inlet duct does not mix with air from the second air inlet duct in the interior volume.

An embodiment of an air intake system for an engine, comprises a first inlet flow path routing airflow through a gap between an engine hood and a headlamp, a first air inlet duct, and an outer portion of an air filter in an airbox, an opening of the first air inlet duct positioned externally to the engine compartment and a second inlet flow path routing airflow through a front grille below the engine hood, a second air inlet duct, a funnel, and a central portion of the air filter in the airbox, the funnel configured to block air from the first air inlet duct to enter the central portion of the air filter.

A first example of the air intake system further comprises where the central portion of the air filter blocks airflow therethrough in response to a temperature being less than a threshold temperature, wherein the outer portion of the air filter allows airflow therethrough in response to the temperature being less than the threshold temperature.

A second example of the air intake system, optionally including the first example, further includes where each of the central portion and the outer portion of the air filter allow airflow therethrough in response to the temperature being greater than the threshold temperature.

A third example of the air intake system, optionally including one or more of the previous examples, further includes where the air intake system comprises no additional inlets or outlets other than the first air inlet duct and the second air inlet duct, wherein air in the first air inlet duct does not mix with air in the second air inlet duct.

A fourth example of the air intake system, optionally including one or more of the previous examples, further includes where the second air inlet duct is free of valves and other devices configured to adjust airflow.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for a vehicle, comprising:

a multi-port air intake system comprising a first duct and a second duct each configured to provide air to an air filter, wherein a funnel extends from the second duct and is in face-sharing contact with the air filter, and the first duct receives airflow from a first flow channel extending through a gap between an engine hood and a headlamp of the vehicle.

2. The system of claim 1, wherein the funnel is free of a valve.

3. The system of claim 1, wherein the first duct is positioned longitudinally behind the second duct with regard to a direction of forward travel of the vehicle in which the multi-port air intake system is mounted.

4. The system of claim 1, wherein the first duct is positioned vertically above the second duct with respect to a direction of gravity.

5. The system of claim 1, wherein the funnel blocks gases in the second duct from mixing with gases in the first duct.

6. The system of claim 1, wherein the multi-port air intake system comprises an interior volume divided into a first portion fluidly separated from a second portion, and wherein the interior volume is shaped via surfaces of the multi-port air intake system and the funnel.

7. The system of claim 1, wherein the first duct is positioned under a section of an engine hood.

8. The system of claim 1, wherein the first duct is positioned longitudinally behind the second duct with regard to a direction of forward travel of a the vehicle in which the multi-port air intake system is mounted, and wherein the first duct is positioned vertically above the second duct with respect to a direction of gravity.

9. The system of claim 1, wherein the funnel comprises a trapezoid-shaped cross-section.

10. The system of claim 1, wherein the funnel is free of right corners.

11. An air intake system for an engine of a vehicle, comprising:

a first air inlet duct configured to flow air to only a first portion of an interior volume of a multi-port air induction system; and a second air inlet duct configured to flow air to only a second portion of the interior volume through a funnel free of a valve, the second air inlet duct arranged below the first air inlet duct, wherein the first air inlet duct receives airflow from a first flow channel extending through a gap between an engine hood and a headlamp of the vehicle.

12. The air intake system of claim 11, wherein the interior volume is directly fluidly coupled to an air filter.

13. The air intake system of claim 11, wherein air from the first air inlet duct does not mix with air from the second air inlet duct in the interior volume.

14. An air intake system for an engine, comprising:

a first inlet flow path routing airflow through a gap between an engine hood and a headlamp, a first air inlet duct, and an outer portion of an air filter in an airbox, an opening of the first air inlet duct positioned externally to the engine compartment; and a second inlet flow path routing airflow through a front grille below the engine hood, a second air inlet duct, a funnel, and a central portion of the air filter in the airbox, the funnel configured to block air from the first air inlet duct from entering the central portion of the air filter.

15. The air intake system of claim 14, wherein the central portion of the air filter blocks airflow therethrough in response to an ambient temperature being less than a threshold temperature, wherein the outer portion of the air filter allows airflow therethrough in response to the temperature being less than the threshold temperature.

16. The air intake system of claim 15, wherein each of the central portion and the outer portion of the air filter allow airflow therethrough in response to the temperature being greater than the threshold temperature.

17. The air intake system of claim 14, wherein the second air inlet duct is free of valves and devices that are electrically, mechanically, or pneumatically actuated.

* * * * *